US005135388A

United States Patent [19]

Pettit

[11] Patent Number: 5,135,388

[45] Date of Patent: Aug. 4, 1992

[54] EXTENDED-HANDLE LIGHTER

[76] Inventor: Frederick M. Pettit, 1411 Point Abino Rd. S., Ridgeway, Ontario L0S 1N0, Canada

[21] Appl. No.: 695,925

[22] Filed: May 6, 1991

[51] Int. Cl.[5] ..... F23Q 1/04; F23Q 2/00

[52] U.S. Cl. ..... 431/254; 431/345; 126/25 B; 294/19.1

[58] Field of Search ..... 431/345, 344, 288, 254, 431/275, 274, 276, 277; 126/25 B; 294/19.1

[56] References Cited

U.S. PATENT DOCUMENTS

| | | | |
|---|---|---|---|
| 676,361 | 6/1901 | Glover | 431/345 X |
| 2,728,212 | 12/1955 | Costello | 67/6.1 |
| 4,012,298 | 3/1977 | Somosi et al. | 204/105 R |
| 4,013,398 | 3/1977 | Hendrix | 431/345 X |
| 4,222,734 | 9/1980 | Nolf | 431/344 X |
| 4,253,818 | 3/1981 | Ogawa et al. | 431/142 |
| 4,253,820 | 3/1981 | Jarreau | 126/25 B X |
| 4,259,059 | 3/1981 | Roosa et al. | 431/345 X |
| 4,315,731 | 2/1982 | Moore | 431/345 X |
| 4,389,187 | 6/1983 | Sims | 431/277 |
| 4,462,791 | 7/1984 | Hayden | 431/345 |

*Primary Examiner*—Carl D. Price
*Attorney, Agent, or Firm*—Joseph P. Gastel

[57] ABSTRACT

An extended-handle lighter including an elongated handle, a socket at one end of the handle for receiving a butane lighter, an actuator mounted at the other end of the handle, and a linkage extending between the actuator and the lighter for selectively causing the lighter to produce a flame. The linkage can either be a flexible cable or a rigid rod.

17 Claims, 2 Drawing Sheets

Fig. 5.
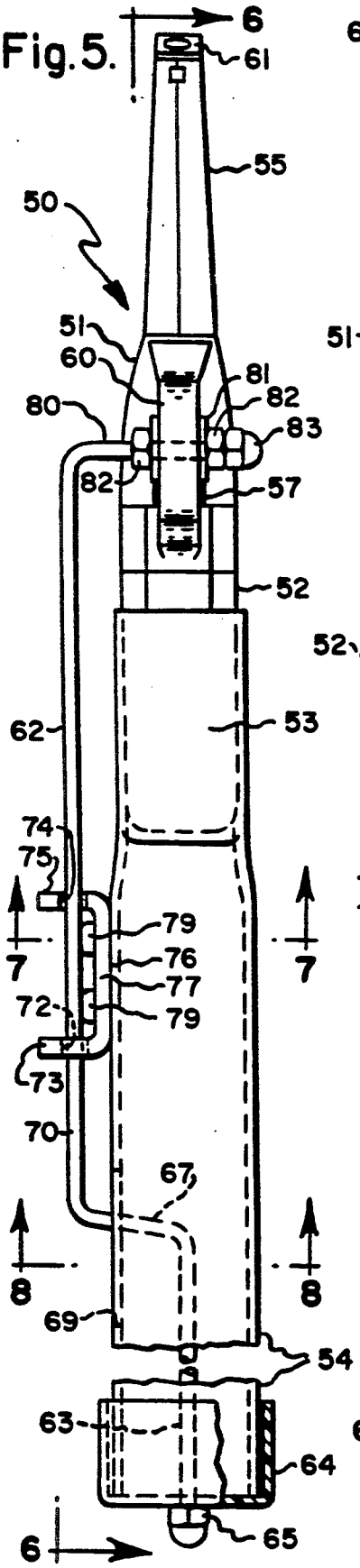
Fig. 6.
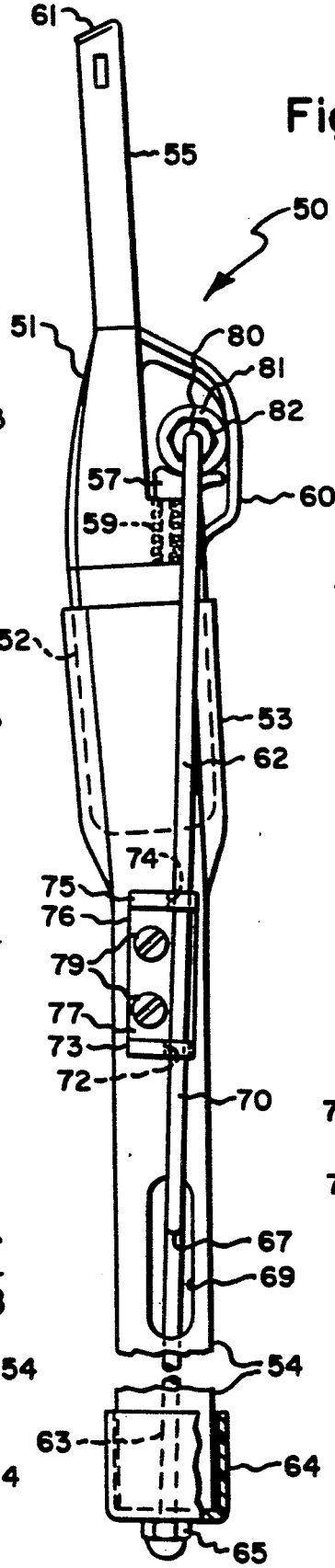
Fig. 7.
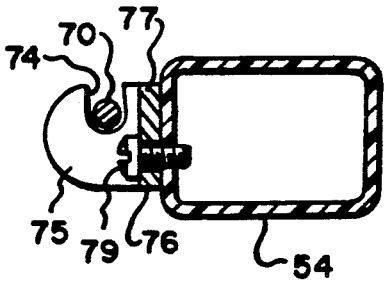
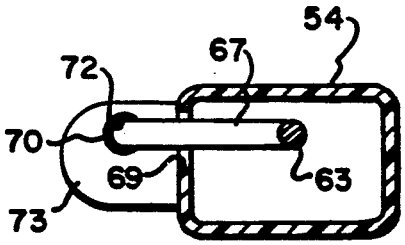
Fig. 8.

EXTENDED-HANDLE LIGHTER

BACKGROUND OF THE INVENTION

The present invention relates to an extended-handle lighter for applying a flame to an object from a distance.

By way of background, there are certain situations wherein it is desirable from a safety aspect to apply a flame to an object from a distance. More specifically, when lighting a natural gas jet, there is always the possibility of a flash when the natural gas is ignited. Also, when lighting charcoal which has been dowsed with a lighting fluid, there is the possibility of a flash fire. Additionally, when lighting candles on a chandelier or on a wall mounting, it is often difficult to reach the candles without the use of a ladder or the like. In all of the foregoing situations, it is convenient to have a lighting device which can apply a flame from a remote position, for the sake of either safety or convenience.

SUMMARY OF THE INVENTION

It is the object of the present invention to provide an extended-handle lighter for producing a flame at a distance remote from a person in the interest of either safety or convenience or both.

Another object of the present invention is to provide an extended-handle lighter construction wherein a conventional butane lighter is replaceably mounted.

A further object of the present invention is to provide an extension handle for mounting and actuating a butane lighter. Other objects and attendant advantages of the present invention will readily be perceived hereafter.

The present invention relates to an extended-handle lighter comprising a lighter having a lighter body and a flame nozzle and a trigger movable between on and off positions and spring means for biasing said trigger to said off position wherein a flame does not emanate from said flame nozzle, an elongated handle having first and second handle ends, mounting means at said first handle end for mounting said lighter body on said elongated handle, actuator means at said second handle end for selectively actuating said trigger, and linkage means effectively coupling said actuator means to said trigger for selectively actuating said trigger against the bias of said spring means to move said trigger to said on position to cause a flame to emanate from said flame nozzle, said spring means returning said trigger to said off position to effect extinguishment of said flame upon deactuation of said actuator means.

The present invention also relates to an extender handle for a lighter comprising an elongated member having first and second ends, means at said first end for mounting a lighter, actuator means at said second end for actuating said lighter, and linkage means extending between said actuator means and said first end for actuating said lighter.

The various aspects of the present invention will be more fully understood when the following portions of the specification are read in conjunction with the accompanying drawings wherein:

BRIEF DESCRIPTION OF THE DRAWINGS

FIG. 5 is a fragmentary side elevational view of another embodiment of an extended-handle lighter;

FIG. 6 is a view taken substantially in the direction of arrows 6—6 of FIG. 5;

FIG. 7 is a cross sectional view taken substantially along line 7—7 of FIG. 5 and showing a portion of the bracket for guiding the actuating linkage; and FIG. 8 is a cross sectional view taken substantially along line 8—8 of FIG. 5 and showing another portion of the guide bracket.

DESCRIPTION OF THE PREFERRED EMBODIMENTS

Figures 1, 1A, 2, 3, 3A, 4:
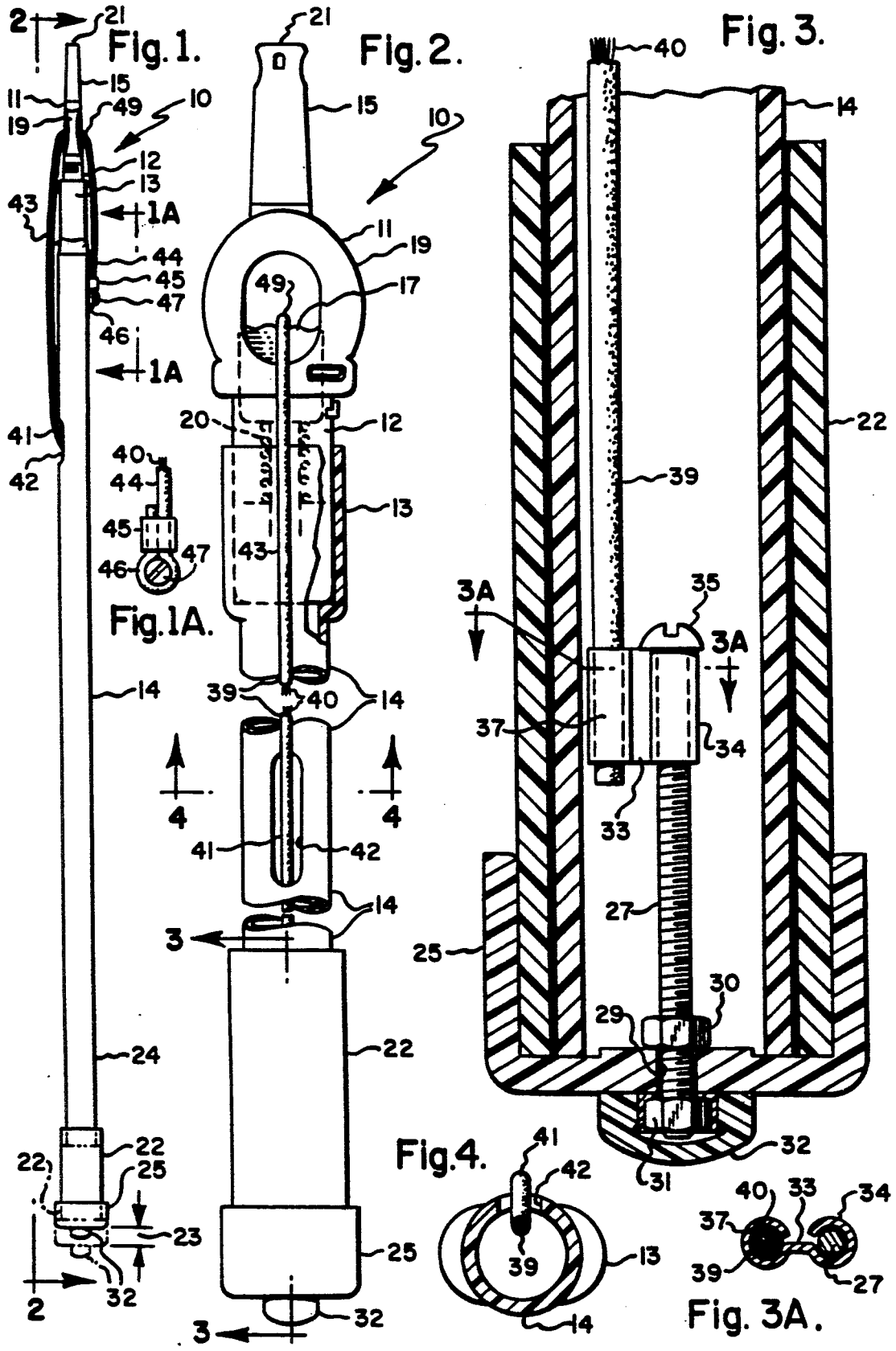
FIG. 1 is a side elevational view of the extended-handle lighter of the present invention.
FIG. 1A is an enlarged view taken substantially in the direction of arrows 1A—1A of FIG. 1.
FIG. 2 is an enlarged fragmentary cross sectional view taken substantially in the direction of arrows 2—2 of FIG. 1.
FIG. 3 is a greatly enlarged cross sectional view taken substantially along line 3—3 of FIG. 2 and showing the actuator construction for the lighter.
FIG. 3A is a cross sectional view taken substantially along line 3A—3A of FIG. 3.
FIG. 4 is a cross sectional view taken substantially along line 4—4 of FIG. 2.

The extended-handle lighter 10 of the present invention includes a butane lighter 11 having a body portion 12 which is removably secured with a friction fit within socket 13 at the end of an extended handle 14. The overall length of the lighter 11 and handle 14 is approximately 40 inches and it is used to produce a flame at substantially that distance from a person who is holding the elongated handle, as in lighting charcoal which has had lighting fluid sprayed thereon, or lighting a natural gas-fed fire, or lighting a candle on a chandelier or the like.

The butane lighter 11, in addition to including a body 12 which contains a supply of butane also includes a flame nozzle 15 from which the flame emanates and a trigger 17 within annular portion 19. Trigger 17 is normally biased to an off position by means of a spring 20 within body portion 12. The foregoing lighter is a conventional device which is known commercially, and therefore there is no need to describe its internal mechanism other than to state that when trigger 17 is depressed to an on position, suitable mechanism within the lighter itself will release the butane and provide the necessary ignition thereof to cause a flame to emanate from the end 21 of the flame nozzle 15. When the trigger is released to an off position, the flow of butane will cease and the flame will be extinguished.

In accordance with the present invention, the lighter 11 is actuated by moving actuator 22 a distance 23 from its solid-line position in FIG. 1 to its dotted-line position. Actuator 22 is moved by a person which grasps it with one hand while holding the elongated handle 14 in the area 24 proximate actuator 22. Actuator 22 is a tubular cylindrical member having a cap 25 secured to the end thereof. Actuator 22 can slide back and forth on tubular handle 14. A bolt 27 is secured within bore 29 of cap 25 by a pair of spaced nuts 30 and 31, and a cover 32 covers the latter. A cable clamp 33 has a portion 34 crimped about bolt 27 proximate bolt head 35 and it has another portion 37 crimped about the end of flexible plastic cable 39 which has a wire core 40. A central portion 41 of flexible cable 39 extends from inside handle 14 to the outside thereof through slot 42 in handle 14. The portion 43 extends upwardly along the outside of handle 14, through the opening in annular lighter portion 19, and its end 44 is formed into a loop 46 by cable clamp 45, and this loop 46 is secured to the outside of elongated handle 14 by means of a screw 47 which is screwed to handle 14.

The portions 43 and 44 of the flexible cable 39 form a loop at the upper end of handle 14. The dimensions are such that when actuator 22 is moved a distance 23 to its dotted-line position of FIG. 1, the cable will be tensioned and the portion 49 overlying trigger 17 will move it to an on position against the bias of spring 20 to cause the lighter to produce a flame which will continue as long as actuator 22 is in its dotted-line position. When it is released, the cable will slacken and spring 20 will expand to move trigger 17 back to its off position to cause the flame emanating from nozzle end 21 to become extinguished.

Another embodiment of the present invention is shown in FIGS. 5–8. The extended-handle lighter 50 includes a butane lighter 51 having a body portion 52 which is removably received with a friction fit within socket 53 at the end of hollow tubular handle 54. Extended handle lighter 50 may be of the same length as extended-handle lighter 10 of FIG. 1. Lighter 51 includes a flame nozzle 55 and a trigger 57 which is normally biased to an off position by spring 59. Trigger 57 is located within a trigger guard 60. Lighter 51 is of a conventional type which has internal mechanism for initiating the necessary release of butane gas and the flash to ignite the released butane upon the actuation of trigger 57 to its on position. The flame will emanate from nozzle end 61 for as long as trigger 57 remains depressed to an on position, and when it is released, trigger spring 59 will return trigger 57 to an off position and the flame will terminate.

Trigger 57 is moved to an on position by means of a linkage 62 which comprises a suitably bent rigid rod. More specifically, an end 63 of rod 62 has actuator cap 64 mounted thereon by a nut 65. Rod end 63 is straight up to bend 67 at a central portion of the rod. Bend 67 passes through slot 69 in hollow handle 54. A straight portion 70 of rod 62 passes through oversized hole 72 in bracket tab 73 and thereafter passes through oversized slot 74 in bracket tab 75. Tabs 73 and 75 mounted on base 77 of bracket 76, and base 77 is secured to tubular handle 54 by means of a pair of screws 79. The outer end of rod portion 62 is bent to form an end portion 80 which mounts roller 81 which is rotatable between nuts 82. A nut 83 is mounted on the outer end of rod portion 80. Thus, when actuator 64 is moved downwardly, rod 62, as guided by bracket tabs 73 and 75, will also move downwardly and roller 81 will press against trigger 57 to move it from its off position to an on position against the bias of spring 59. When actuator 64 is released, spring 59 will expand to move trigger 57 back to its off position and in doing so will move roller 81 with it.

Bracket 76 is of a construction to permit rod 62, after it has been bent to the configuration shown, to be threaded therethrough. In this respect, the lower end 63 is threaded through oversized hole 72 first and the portions 67 and 70 are guided through hole 72. Thereafter, the portion 62 is slipped sideways into slot 74. It is to be noted that screws 79 are located to the side of the portion of the rod which is located between tabs 73 and 75, and thus screws 79 can be installed after rod portion 62 is in position.

The handles 14 and 54 may be made of any suitable material such as plastic or metal, preferably the former.

It can thus be seen that the extended-handle lighter of the present invention is manifestly capable of achieving the above-enumerated objects and while preferred embodiments of the present invention have been disclosed, it will be appreciated that it is not limited thereto but may be otherwise embodied within the scope of the following claims.

What is claimed is:

1. An extender handle for a lighter comprising an elongated member having first and second ends, means at said first end for mounting a lighter, actuator means at said second end for actuating said lighter, and linkage means extending between said actuator means and said first end for actuating said lighter, said linkage means comprising a cable having a first end coupled to said actuator means and a second end secured to said elongated member.

2. An extender handle for a lighter as set forth in claim 1 wherein said means at said first end comprises a socket.

3. An extender handle for a lighter as set forth in claim 1 wherein said elongated member is tubular, and wherein said cable is located within said tubular member proximate said actuator means, and wherein said cable is located outside of said tubular member proximate said first end of said elongated member.

4. An extender handle for a lighter comprising an elongated member having first and second ends, means at said first end for mounting a lighter, actuator means at said second end for actuating said lighter, and linkage means extending between said actuator means and said first end for actuating said lighter, said linkage means comprising a rod having a first end coupled to said actuator means and a second end positioned at said lighter, and said second end of said rod mounting a roller for actuating said lighter.

5. An extender handle for a lighter as set forth in claim 4 wherein said elongated member is tubular, and wherein said first end of said rod is located within said tubular member.

6. An extender handle for a lighter as set forth in claim 5 wherein said second end of said rod is located outside of said tubular member, a slot in said tubular member through which a central portion of said rod passes, and bracket means on the outside of said tubular member for guiding said rod.

7. An extender handle for a lighter as set forth in claim 4 wherein said means at said first end comprises a socket.

8. An extended-handle lighter comprising a lighter having a lighter body and a flame nozzle and a trigger movable between on and off positions and spring means for biasing said trigger to said off position wherein a flame does not emanate from said flame nozzle, an elongated handle having first and second handle ends, mounting means at said first handle end for mounting said lighter body on said elongated handle, actuator means at said second handle end for selectively actuating said trigger, linkage means effectively coupling said actuator means to said trigger for selectively actuating said trigger against the bias of said spring means to move said trigger to said on position to cause a flame to emanate from said flame nozzle, said spring means returning said trigger to said off position to effect extinguishment of said flame upon deactuation of said actuator means, said linkage means comprising an elongated cable having first and second ends, first means for anchoring said first end of said cable to said elongated handle, second means for connecting said second end of said cable to said actuator means, and third means between said first and second means for engaging said trigger.

9. An extended-handle lighter as set forth in claim 8 wherein said elongated handle is hollow, and wherein said first end of said cable is anchored to the outside of said elongated handle, an opening in said elonged handle for receiving a portion of said cable between said first and second ends, and wherein said second end of said cable is located within said hollow elongated handle.

10. An extended-handle lighter as set forth in claim 9 wherein said actuator means comprises a member slidable on said second handle end.

11. An extended-handle lighter as set forth in claim 10 wherein said member comprises a tubular member at the extreme second handle end of said elongated handle.

12. An extended-handle lighter comprising a lighter having a lighter body and a flame nozzle and a trigger movable between on and off positions and spring means for biasing said trigger to said off position wherein a flame does not emanate from said flame nozzle, an elongated handle having first and second handle ends, mounting means at said first handle end for mounting said lighter body on said elongated handle, actuator means at said second handle end for selectively actuating said trigger, linkage means effectively coupling said actuator means to said trigger for selectively actuating said trigger against the bias of said spring means to move said trigger to said on position to cause a flame to emanate from said flame nozzle, said spring means returning said trigger to said off position to effect extinguishment of said flame upon deactuation of said actuator means, said linkage means comprising an elongated rod having first and second ends, first means at said first end for engaging said trigger, second means for connecting said second end to said actuator means, said first means comprising a roller, and a trigger guard on said lighter for confining said roller against said trigger.

13. An extended-handle lighter as set forth in claim 12 wherein said elongated handle is hollow, an opening in said elongated handle, a portion on said rod having a bend therein for causing said portion of said rod to pass through said opening, and said second end of said rod being located within said handle.

14. An extended-handle lighter as set forth in claim 12 including guide means on said elongated handle located between said first handle end and said opening.

15. An extended-handle lighter as set forth in claim 14 wherein said guide means comprises a bracket having a pair of spaced upstanding tabs with a hole in one of said tabs and a slot in the other of said tabs.

16. An extended-handle lighter as set forth in claim 15 wherein said hole and said slot are positioned off-center on said tabs.

17. An extended-handle lighter as set forth in claim 15 including a base on said bracket between said tabs, and screw means for securing said base to said elongated handle.

* * * * *